United States Patent [19]

Hanson

[11] 4,173,830

[45] Nov. 13, 1979

[54] DRYER FOR MESH BASKETS

[76] Inventor: Douglas R. Hanson, 1720-9th Ave. South, Anoka, Minn. 55303

[21] Appl. No.: 859,276

[22] Filed: Dec. 12, 1977

[51] Int. Cl.[2] ..... F26B 5/04

[52] U.S. Cl. ..... 34/15; 34/77; 34/92

[58] Field of Search ..... 34/15, 28, 72, 77, 92

[56] References Cited

U.S. PATENT DOCUMENTS

| | | | |
|---|---|---|---|
| 2,152,312 | 3/1939 | Jennings et al. | 34/28 X |
| 2,386,676 | 10/1945 | French | 34/28 X |
| 3,258,854 | 7/1966 | Ascoli et al. | 34/237 |
| 3,866,333 | 2/1975 | Sarokahanian et al. | 34/77 |

*Primary Examiner*—John J. Camby

*Attorney, Agent, or Firm*—Kinney, Lange, Westman & Fairbairn

[57] ABSTRACT

A dryer for automated washing and drying of mesh or perforated bottom trays such as those used for bakery goods, which includes a source of air under relatively low pressure and has a means to direct air at a relatively high velocity through the mesh or open bottom tray as it is carried on a perforated or open conveyor, and vacuum means connected to the suction side of the same fan to collect and receive moisture laden air and water droplets that pass through the tray and the conveyor. The fan includes a water-air separator on the inlet side so that the inlet air carrying the water is processed to remove water droplets and the like.

6 Claims, 3 Drawing Figures

DRYER FOR MESH BASKETS

BACKGROUND OF THE INVENTION

1. Field of the Invention

The present invention relates to dryers for drying perforated or mesh bottom trays or similar objects carried on a conveyor.

2. Prior Art

In the prior art various dryers have been advanced, but usually they require some input of heat, and require a substantial length of time for drying so that they are not very adaptable to use with a conveyor operation where items are carried directly from a washing apparatus on a conveyor to a storage area. Further, the costs of operation of most dryers is generally relatively high, as well as costs of manufacture being high.

SUMMARY OF THE INVENTION

The present invention relates to a dryer for items that have open mesh or perforated bottom walls, such as trays used for carrying bakery goods, and which are transported on an open work conveyor from a washing machine or area. The dryer comprises a fan assembly having a pressure output side opening that direct air under pressure onto the items to be dried, and the vacuum side of the fan intakes air through vacuum inlets positioned below the conveyor and aligned with the pressure openings so that the air is circulated, and the moisture laden air is sucked into the vacuum side of the blower. Suitable air-water separators are utilized for separating out the water particles and moisture laden air.

The device is relatively simple to make and operate, and does not use any external heaters, although the air is heated somewhat from compression caused by the fan. The drawings show the apparatus schematically to provide the continuous circulation of air to force water droplets from items being carried on an open conveyor such as a mesh or rod conveyor through the conveyor and into the vacuum side of the same fan which provides the pressure for the air.

BRIEF DESCRIPTION OF THE DRAWINGS

FIG. 1 is a schematic side elevation view of a tray conveyor showing a drying apparatus utilized with the conveyor for drying trays having perforated or open mesh bottoms;

DESCRIPTION OF THE PREFERRED EMBODIMENT

Figure 2:
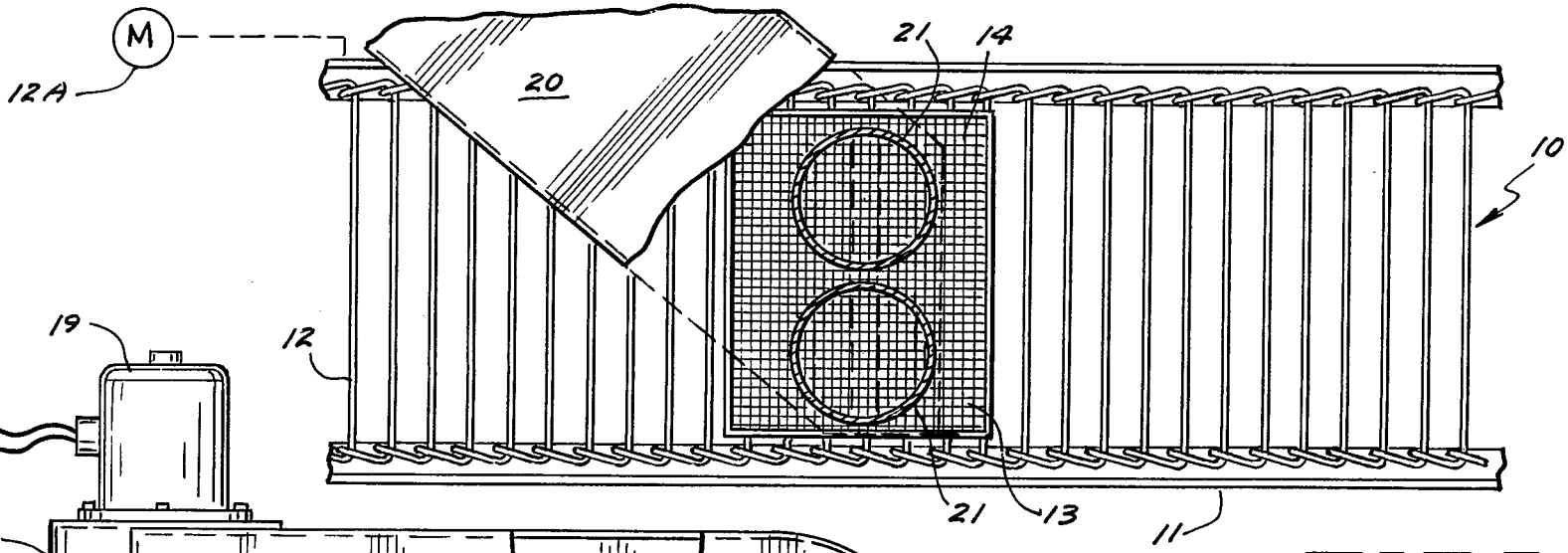
FIG. 2 is a top plan view of the device of FIG. 1 with parts in section and parts broken away.

Referring to the drawings of the numerals of reference thereon, an open work conveyor indicated generally at 10 includes a conveyor frame 11, which in the form shown comprises an endless chain type, cross rod conveyor "belt" member 12. In place of the cross rod type conveyor 12, an open mesh conveyor could also be used. The conveyor is similar to chain conveyors used in various separating conveyors such as potato handling conveyors. The conveyor member is made to support on its upper surface trays such as the tray indicated at 13 which has an open mesh or perforated bottom indicated at 14. The bottoms of such trays have perforations which permit air to pass through. The tray 14 includes upright walls 15 surrounding the bottom, and is used for carrying bakery goods from the bakery to bulk users for example. These trays are washed in automatic washing machines (not shown) and then are placed on the conveyor 12. The trays are carried along the upper reach of the conveyor. The return portion or lower reach of the conveyor belt member 12 is not shown, and is guided to be below the apparatus for drying which is to be described. The conveyor or member 12 is driven by a motor 12A, shown schematically and suitable drive connection.

The drying apparatus indicated generally at 16 includes a source of fluid under pressure, such as an axial flow compressing fan assembly mounted in a housing 17, and including axial flow fan blades 18 which are shown only schematically, driven from a motor 19. About a 15 horsepower motor has been used. The fan 18 as shown has a pressure side at the upper end of the housing 17, and a vacuum side below the fan blades at the lower portion of housing 17. Suitable shrouds may be used on the interior of housing 17 to properly duct the fan.

The housing 17 has an outlet near its upper end which leads to a large duct or plenum 20 that extends laterally and out over the upper reach of the conveyor 12. The duct 20 has a pair of round pipes 21 extending downwardly therefrom directly over the conveyor as shown in cross section in FIG. 2. The pipes are side by side and span the entire width of a tray carried on the conveyor.

The pipes 21 therefore carry air under pressure from the fan 18 when the motor 19 is running, and this air is directed downwardly through the pipe sections 21 onto a tray 13 on the conveyor that passes below the pipes on the conveyor. The volume of air carried by the pipes 21 is large and the velocity is relatively high. This high velocity air blows water droplets off the walls 15 of the tray and off the portions of the bottom wall 14, through the perforations in the bottom wall, and also through the slats or rods of conveyor 12.

Figure 3:
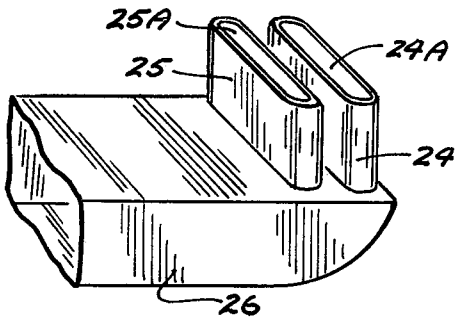
FIG. 3 is a top plan view of a typical vacuum nozzle arrangement used in the apparatus of FIG. 1.
Figure 7:
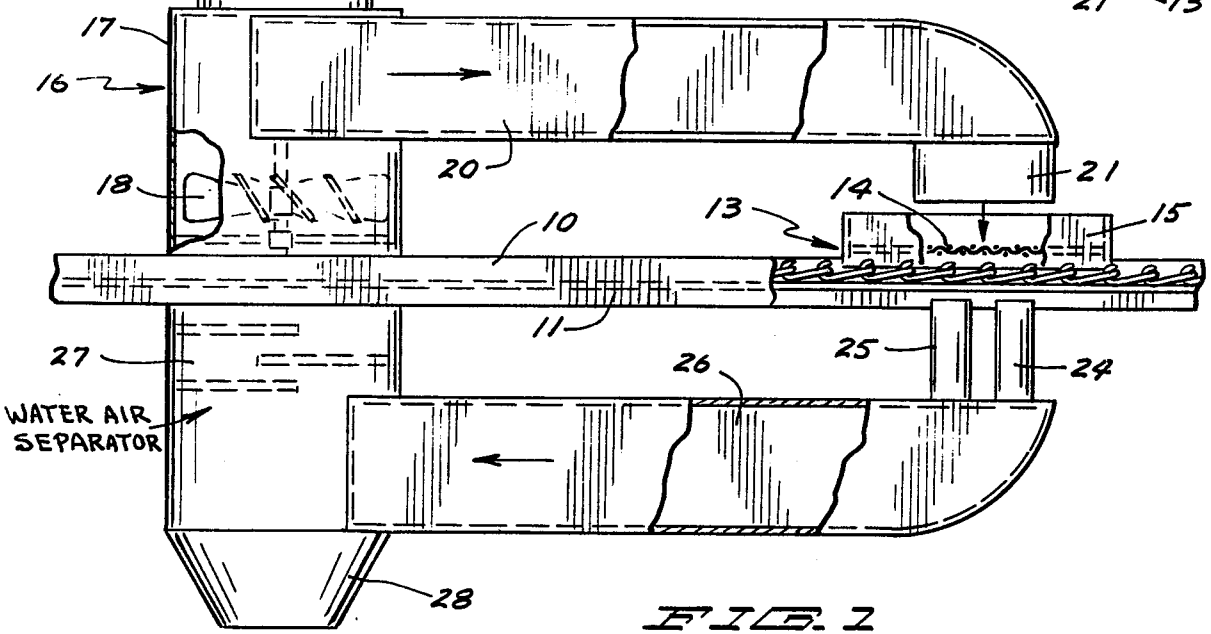

Below the conveyor there are a pair of vacuum nozzles 24 and 25, respectively which have upwardly facing ports indicated generally at 25A and 24A in FIG. 3. The ports are elongated to extend laterally across the entire width of the conveyor and thus across the full width of the tray. The nozzles 24 and 25 underlie the two pipes 21 in their side by side position. The nozzles are in series in relation to the direction of movement of the conveyor or belt. That is, the tray 13 passes first nozzle 25 and the nozzle 24 as it moves.

The vacuum ports 24A and 25A take in the water laden air being discharged by the pipes 21 and 22 under vacuum, which water laden air then passes into a duct 26 that leads to the lower portion of the housing 17. The lower portion of housing 17 comprises a water-air separator section 27. The separator can be designed in a known way using baffles which cause the air to change direction several times. Water drains down through the tapered portion 28 of the housing 17 and out into a suitable drain or the like. The water-air separator can be any desired type such as baffling which causes the inlet air from the duct 26, and the vacuum side of the fan 18 to change direction, become turbulent, slow down, or expand, or a centrifugal type separator could be utilized on the interior of the housing 17.

No additional heat is added to the air that is circulated through the housing 17 and ducts 20 and 26, but the air does heat slightly from compression. The speed of the fan 18 can be selected to provide the desired velocity out the nozzles 21 and 22, which substantially span or at least cover the major lateral dimention portion of the tray 13, and as the trays move past the nozzles 21 and 22 the entire bottom wall 14 is subjected to a blast of air to remove water particles and the like. This air is recovered by the vacuum nozzles and recirculated after the air-water separation.

the device therefore comprises a continuously circulating quantity of air having high velocity-low pressure air to blow water off and through a tray or article to be dried, and vacuum nozzles leading to the low pressure side of the same fan sucking in the water and air removed from the articles back into the fan for recirculation.

Any type of conveyor may be utilized as long as it is sufficiently open to permit the air to flow freely through the conveyor.

Only one pressure nozzle 21 will work, and also only one vacuum nozzle will work. The nozzles may be shaped differently if desired.

In use an airflow of 4,0000 cubic feet per minute out two twelve inch diameter pipes 21 has proved to be sufficient for operation in a satisfactory manner. A power source of fifteen horsepower provide sufficient power. The velocity and volume of the air blows the water off the trays, rather than drying the water off. The fan and housing can be separated into two sections if desired so that each pipe 21 was powered by a separate fan.

Also, known centrifugal separators may be used for the water air separator, and it should be noted that the intake on the vacuum side may have a larger area than on the pressure side. Some air is lost out the sides of the opening at the tray and conveyor. The entire section of the conveyor in which the dryer assembly is located can be enclosed in a housing (not shown). That is a large housing could enclose the members shown in FIG. 1, with entry and exit slots for the conveyor and trays. The slots could be draped or shielded to minimize air losses.

What is claimed is:

1. A drying apparatus for drying perforated bottom articles carried by an open work conveyor comprising a fan assembly, said fan assembly having an outlet providing a desired substantial volume of air at a substantial velocity forming an airstream, means directing said airstream toward said perforated article on said conveyor, and means to thereby force said airstream through said article and said conveyor, and vacuum means comprising the low pressure side of said fan assembly and including vacuum port means aligned with said means to direct said airstream toward said article, said vacuum port means thereby collecting air forced through said article and said conveyor.

2. The combination as specified in claim 1 wherein said conveyor includes a generally horizontal section, and said means for directing the air stream facing generally vertically downwardly, and said vacuum port means being positioned below said article.

3. The combination as specified in claim 1 wherein said means for directing the air stream comprises nozzle means substantially spanning the article carried by said conveyor.

4. The combination as specified in claim 1 and separator means to subject air carried by said vacuum nozzle to air-water separation.

5. An apparatus for drying perforated bottom trays carried along an open work conveyor member and supported on said open work conveyor member in a generally horizontal plane comprising first means to provide air under pressure, duct means including outlet nozzles positioned above a tray carried by said conveyor and positioned to overlie said tray as the tray is moved along said conveyor, said nozzle means directing a flow of a high velocity air stream against said tray to force water on the tray to be carried through the tray and blown off said tray, second means to provide a vacuum nozzle positioned below said tray and conveyor member as the tray is carried by said conveyor member, said vacuum nozzle means being arranged to collect substantially all of the air passing from said first mentioned nozzle through said tray, and means to return said air from said vacuum nozzle to be recirculated through said first means.

6. A method of removing water from and drying perforated bottom articles carried on a conveyor using a recirculating fan member having a pressure side and a vacuum side, said fan generating a desired volume of air, comprising the steps of directing air from said pressure side of the fan in a high velocity stream directly through the perforated bottom of the article as it is moved on said conveyor to force the airstream to pass through the perforated bottom of said article and to carry water on the article through said article, collecting the water laden air that has passed through said article and returning said water laden air to the vacuum side of said fan, and separating at least portions of the water carried by the air to the vacuum side of the fan out of the airstream prior to recirculation of the air by said fan.

* * * * *

UNITED STATES PATENT OFFICE

CERTIFICATE OF CORRECTION

Patent No. 4,173,830 Dated November 13, 1979

Inventor(s) Douglas R. Hanson

It is certified that error appears in the above-identified patent and that said Letters Patent are hereby corrected as shown below:

Column 3, line 22, "4,0000" should be --4,000.

Signed and Sealed this

*Eleventh* Day of *March 1980*

[SEAL]

*Attest:*

SIDNEY A. DIAMOND

*Attesting Officer*

*Commissioner of Patents and Trademarks*